US006953032B2

(12) United States Patent
Goede

(10) Patent No.: US 6,953,032 B2
(45) Date of Patent: Oct. 11, 2005

(54) COMBUSTION ENGINE AND IGNITION CIRCUIT FOR A COMBUSTION ENGINE

(76) Inventor: Simon Lucas Goede, Oterlekerweg 4, NL-1841 GP Stompetoren (NL)

( * ) Notice: Subject to any disclaimer, the term of this patent is extended or adjusted under 35 U.S.C. 154(b) by 0 days.

(21) Appl. No.: 10/857,615

(22) Filed: May 28, 2004

(65) Prior Publication Data

US 2005/0000500 A1 Jan. 6, 2005

Related U.S. Application Data

(63) Continuation-in-part of application No. PCT/NL02/00774, filed on Nov. 29, 2002.

(30) Foreign Application Priority Data

Nov. 29, 2001 (NL) ..... 1019448

(51) Int. Cl.[7] ..... F02P 3/06
(52) U.S. Cl. ..... 123/606
(58) Field of Search ..... 123/594, 606, 123/607, 596, 598, 601

(56) References Cited

U.S. PATENT DOCUMENTS

| | | | |
|---|---|---|---|
| 4,366,801 | A | 1/1983 | Endo et al. |
| 4,677,960 | A | 7/1987 | Ward |
| 4,846,129 | A | 7/1989 | Noble |
| 5,456,241 | A | 10/1995 | Ward |
| 5,495,757 | A | 3/1996 | Atanasyan et al. |
| 5,842,456 | A | 12/1998 | Morganti |

FOREIGN PATENT DOCUMENTS

| | | | |
|---|---|---|---|
| DE | 100 37 536 | A1 | 2/2002 |
| EP | 0 893 600 | A1 | 1/1999 |
| EP | 0 913 897 | A1 | 5/1999 |
| WO | WO 00/50747 | | 8/2000 |
| WO | WO 01/33073 | A1 | 5/2001 |

*Primary Examiner*—Bibhu Mohanty
(74) *Attorney, Agent, or Firm*—The Webb Law Firm

(57) ABSTRACT

An internal combustion engine includes a cylinder with a spark plug, an electric DC voltage supply, and an ignition circuit. The ignition circuit includes a switching device and a transformer having a primary winding coupled to the supply via the switching device, and a secondary winding coupled to the spark plug. After having generated an initial breakdown of a breakdown path through a gas mixture between electrodes of the spark plug, switching occurs repeatedly per combustion to produce pulses at the primary winding, with a repeat frequency which is at least sufficiently high that the breakdown path remains conductive between consecutive switches per combustion. The switching on and switching off provides heating of the breakdown path to ignite the gas mixture. The transformer has an air core around which the primary and secondary windings are arranged concentrically.

4 Claims, 3 Drawing Sheets

COMBUSTION ENGINE AND IGNITION CIRCUIT FOR A COMBUSTION ENGINE

CROSS-REFERENCE TO RELATED APPLICATIONS

This application is a continuation-in-part of International Patent Application Number PCT/NL02/00774, filed Nov. 29, 2002, entitled "Combustion Engine and Ignition Circuit for a Combustion Engine" and designating, inter alia, the United States, which claims priority to Netherlands Patent Application Serial No. 1019448, filed Nov. 29, 2001, both of which applications are herein incorporated by reference in their entirety.

BACKGROUND OF THE INVENTION

The invention relates to an internal combustion engine comprising a cylinder with a spark plug, an electric DC voltage supply and an ignition circuit.

Internal combustion engines provided with spark plugs for igniting a gas mixture in a cylinder are generally known. Such engines are provided with an ignition coil, which is essentially a transformer with a switch between a primary winding of the transformer and an electric supply such as an accumulator and a coupling of the secondary winding to the spark plug. The ignition coil provides for a high voltage across the electrodes of the spark plug, which leads to a spark-over so that the gas mixture is ignited.

U.S. Pat. No. 5,456,241 discloses an ignition circuit for an internal combustion engine. This ignition circuit includes a capacitor which forms a resonant circuit with a series connection of the primary winding and a supplementary coil. To generate high voltages, first the capacitor is charged, while a switch keeps the current path through the primary winding and the supplementary coil interrupted. Next, the switch is rendered conductive. This leads to a dampened oscillation with voltage peaks which, via the transformer, lead to the desired high voltages across the electrodes of the spark plug. Upon the first voltage peak, an electric breakdown through the gas mixture occurs, so that a breakdown path through the gas mixture between the electrodes becomes conductive. Next, the rest of the oscillations lead to an oscillating current through the breakdown path. Thus, the gas mixture is heated to a temperature at which combustion occurs. An important parameter of such an ignition is the energy thereby transferred to the spark plug. Further, erosion of the spark plugs resulting from the discharge impact is an important parameter. U.S. Pat. No. 5,456,241 describes how the switch is made conductive and non-conductive several times for the same combustion. Thus, the capacitor can be charged several times and more energy is transferred to the spark plug than through switching the switch a single time.

U.S. Pat. No. 5,456,241 further describes how the amount of energy that can be transferred from the supply to the gas mixture decreases according as the speed of the motor increases. While this effect is counteracted by increasing the frequency with which the switch is switched on and off at higher speeds, the amount of energy nonetheless decreases at higher speeds. This is because at high speeds the time between consecutive combustions of the gas mixture more and more approximates the charging time needed to charge the resonant circuit. This charging time is fairly great, because a fairly large self-induction of the primary winding is needed for the storage of sufficient energy for igniting the gas mixture.

U.S. Pat. No. 4,677,960 describes a capacitive discharge ignition circuit using a high efficiency voltage doubling ignition coil. The ignition is used with a high pulse rate, multiple pulse ignition box providing rapid pulsed plasma ignition sites. The circuit may include an energy storage capacitor but the coil will also operate with standard or electronic ignition excepting that full advantage cannot be taken of the high current/voltage capabilities of the coil since these ignitions cannot store high energy rapidly. Because the coil comprises a core made of ferrite, the possible frequencies applied to a spark plug are limited to approximately 30 kHz.

U.S. Pat. No. 5,842,456 shows a multi-firing ignition circuit with which several pulses per combustion cycle can be supplied to a spark plug. Concrete circuits are not shown, but the patent does mention that here too use is made of energy from a capacitance in a "capacitive discharge coil-on-plug" circuit. The patent does not speak of the use of an existing breakdown path to generate an oscillating current through the gas mixture with several pulses.

European patent application No. 893600 shows the use of several pulses per combustion. The patent application does not speak of the use of an existing breakdown path to generate an oscillating current through the gas mixture with several pulses.

European patent application 0913897, German patent application DE10037536and PCT patent application 0133073 describes the use of plasma ignitions, in which very high-frequency electromagnetic signal sources, up to inter alia laser and microwave sources, are used to heat gas mixtures. European patent application 0913897 describes a plasma ignition circuit in which the gas mixture is ignited by thermal energy from a high-frequency field. This publication provides for the ignition of different plasma filaments one after the other, by means of a special kind of spark plug. Details about the high-frequency circuit are not given. U.S. Pat. No. 4,366,801 discloses an ignition circuit with a resonant circuit for generating pulses. DE10037536 utilizes signals of about 1 Ghz, but further does not describe any circuits. PCT patent applications 0133073 describes the use of laser light or microwaves of a plasma, after this has been rendered conductive with an electric pulse.

U.S. Pat. No. 4,366,801 discloses the use of a number of transformers, each for its own spark plug, and each in series with a capacitor, with which the transformer forms a resonant circuit, so that a resonant signal is generated across the spark plug. PCT patent application WO0050747 describes an ignition which, after a breakdown generating pulse, generates a sequence of further voltage oscillations across the electrodes of the spark plug, whereby a reactance circuit causes the voltage of the voltage oscillations to decrease once the breakdown path is conductive. If the breakdown path is interrupted, the voltage increases again. This publication shows an oscillator to generate the pulses with a frequency in the band of 1–100 kHz. The pulse forming circuit comprises the transformer and a capacitor which jointly work as a resonant circuit.

As far as these ignition devices work with spark plugs that have electrodes between which electric fields are generated, all these devices utilize a transformer of which the secondary winding is coupled to the electrodes and of which the primary winding is included in a resonant circuit. This enables efficient transfer of the needed energy to the electrodes. However, it also has as an effect that the maximum rise speed of the field across the electrodes is related to the pulse repeat frequency. When effecting the initial breakdown between the electrodes, the circuit must deliver a voltage so high as to be sufficient to create a breakdown path.

U.S. Pat. No. 4,846,129 describes an ignition system wherein a detector is employed to sense the first or "breakdown" phase of spark discharge across a spark plug which causes a short duration high current flow across the plug gap. The detection of the breakdown current enables control over a number of ignition system functions. A pulse transformer is used which enables extremely short duration energization of the spark plug at controllable voltages. The spark plug may be caused to multiply discharge within a short duration which has been found to increase the lean burn limit of the engine. Rapid multiple firing of the plug is achieved by sensing the existence of breakdown current which signifies the discharge event. This signal is used to immediately curtail that discharge cycle and begin another firing cycle, enabling multiple discharges to occur in a very short time duration. However, at each discharge the electrodes of the spark plug are eroded by the repeatedly particle impacts resulting in a relatively short spark plug lifetime.

It is one object of the invention to provide an improved internal combustion engine and an ignition circuit for such an internal combustion engine.

Therefore, the invention relates to an internal combustion engine comprising a cylinder with a spark plug, an electric DC voltage supply and an ignition circuit, which ignition circuit is provided with a switching device and a transformer having a primary winding, which is coupled to the supply via the switching device, and a secondary winding which is coupled to the spark plug, the switching device being arranged for (i.e., configured such that), after having generated an initial breakdown of a breakdown path through a gas mixture between electrodes of the spark plug, switching repeatedly per combustion to produce pulses at the primary winding, with a repeat frequency which is at least so high that the breakdown path remains conductive between consecutive switches per combustion, so that the switching on and switching off of a high current leads to a heating of the breakdown path in order to ignite the gas mixture, wherein the transformer comprises an air core around which the primary and secondary winding are arranged concentrically.

This arrangement is preferable when transforming high frequency pulses. No energy is stored in the core, resulting in a transformer wherein the rise time of the pulses in the secondary winding can be as high as 2 kV/ns or even higher. This very high rise speed leads to a greater energy content in the gas mixture by means of dielectric heating. As a result, a less high voltage can suffice for generating the initial breakdown.

The primary winding is provided with energy from the DC voltage supply repeatedly during the combustion, without making use of energy which is stored in a resonant circuit. By doing this with a sufficiently high frequency, sufficient energy for the combustion can be supplied without energy from a resonant circuit being necessary. Thus, it can suffice to use a primary winding with a low self-induction, which can be charged again faster, so that fewer problems arise at high speeds. A resonant circuit is now not necessary anymore to generate sufficient energy for the combustion.

Further, also, the erosion of the electrode of the spark plug is less because the kinetic energy of the impacting particles is not high enough to disrupt the structural integrity of the electrode material. As the rest of the pulses of the signal lead to an alternating current through the existing breakdown path, without a new breakdown being necessary in the respective combustion cycle, there does not further arise any erosion either. The minimum repeat frequency needed for this purpose depends on the engine design, typical values being, for instance, between 100 kHz and 10 MHz. In the combustion engine according to the invention, the gas mixture is heated by the high frequency current pulses to a temperature at which combustion occurs.

Preferably, in substantially every period of the repeated switching, the same fraction of the energy for combustion of the gas mixture is supplied.

Thus, the energy is supplied, for instance, equally distributed over fifty or more pulses per combustion, or even over eighty or more pulses and preferably a hundred or more pulses per combustion. As a result, no great current per pulse is needed.

The duty cycle and/or the frequency with which the switching device connects the supply with the primary winding may be modulatable. Thus, the amount of energy that is supplied to the spark plug can be set, for instance depending on the condition of the engine, a measured degree of combustion of previous gas mixtures, the available supply voltage, and so forth. Also, the amount of energy of consecutive periods in which the connection is made conductive can be made variable in a single combustion, for instance by supplying more energy per time unit with later pulses to thereby reduce spark erosion.

The frequency with which current pulses from the supply are led through the primary winding is preferably high above the speed of the engine, preferably as high as is practically possible, for instance in a range of 100 kHz–10 MHz. This is simple to realize with a high frequency generator. Thus, a small transformer can suffice, and high speeds of the engine do not entail any decrease of the energy that is supplied to the spark plug.

In an embodiment, the ignition circuit is arranged to produce a high frequency pulse train at the secondary winding wherein a first pulse of the pulse train has an amplitude of at least 2 Kilovolt and subsequent pulses of the pulse train have amplitudes of less than 300 Volt. After having generated an initial breakdown path in the gas mixture, the voltage of subsequent pulses can be much lower than the initial pulse. The number of subsequent lower pulses per combustion may vary, so that the amount of energy transferred to the gas mixture can be regulated.

BRIEF DESCRIPTION OF THE DRAWINGS

These and other objectives and advantages of the internal combustion engine and ignition according to the invention will be further discussed with reference to the following figures.

DESCRIPTION OF THE PREFERRED EMBODIMENTS

Figure 1:
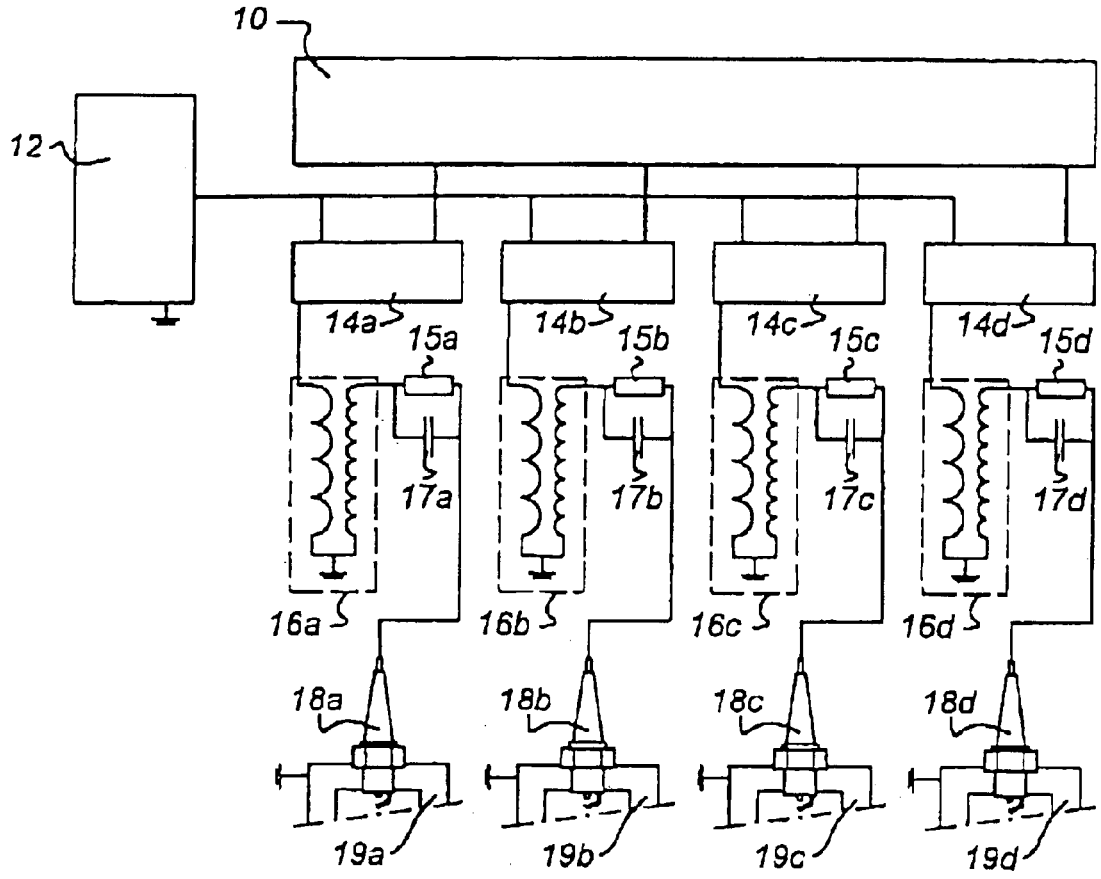
FIG. 1 shows an ignition circuit.

FIG. 1 shows an ignition circuit. The ignition circuit includes an engine management system 10, a supply 12, a number of high-frequency generators 14*a–d*, a number of transformers 16*a–d,* a number of spark plugs 18*a–d* in cylinders 19*a–d*. Each high-frequency generator 14*a–d* has an output which is coupled to a primary winding of a respective transformer 16*a–d*. The secondary windings of the transformers 16*a–d* are coupled to electrodes of the spark plugs 18*a–d* via resistors 15*a–d* connected in parallel to capacitors 17*a–d*. Resistors 15*a–d* may have values of for example 700 Ω and the capacitors may have values of for example 10 nF.

Figure 2:
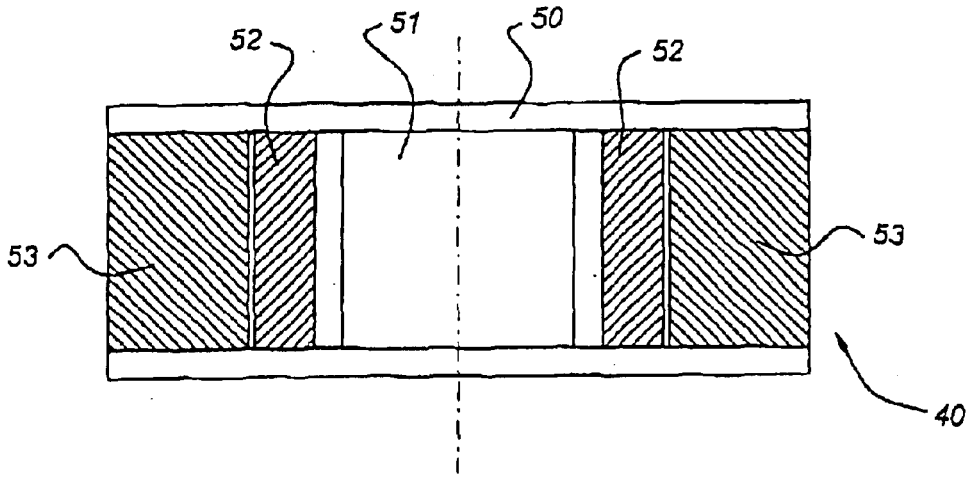
FIG. 2 shows a cross section of an embodiment of a transformer.

In operation, periodically, gas mixtures in the cylinders 19*a–d* are caused to combust through sufficient heating of the breakdown paths in the spark plugs 18*a–d*. The engine management system 10 determines when which spark plug 18*a–d* must cause a gas mixture to combust. When this is the case, the engine management system 10 sends a control signal to the high-frequency generator 14*a–d* that is coupled to the respective spark plug 18*a–d*. The respective high-frequency generator 14*a–d* thereupon generates a sequence of pulses in which the primary winding is connected with the supply 12. According to the invention, the transformers 16*a–d* are arranged as to produce very steep pulses at the secondary windings. The slope of a pulse at the secondary winding is about 2 kV/ns or more. These steep pulses can be produced using a transformer comprising two windings which transfer energy without storing magnetic energy in a coil. FIG. 2 shows a cross section of an embodiment of the transformer 40 comprises a main yoke 50 having an air core 51, around which a primary winding 52 is wound and, isolated from the primary winding 51, a secondary winding 52. Because of the low inductance of the core 41, no energy is stored at high frequencies, i.e. higher than 100 kHz. By providing a steep pulse to the gas mixture, a breakdown path will act as a resistance that can be heated by providing multiple subsequent pulses after the initial pulse within a certain time frame. Only a relatively low voltage (e.g. 2 kV) is needed to cause this effect. The resistors 15*a–d* in FIG. 1 ensure a limited current during breakdown resulting in less erosion of the electrodes of the plug. The capacitors 17*a–d* are provided to conduct the high frequency current.

Figure 3:
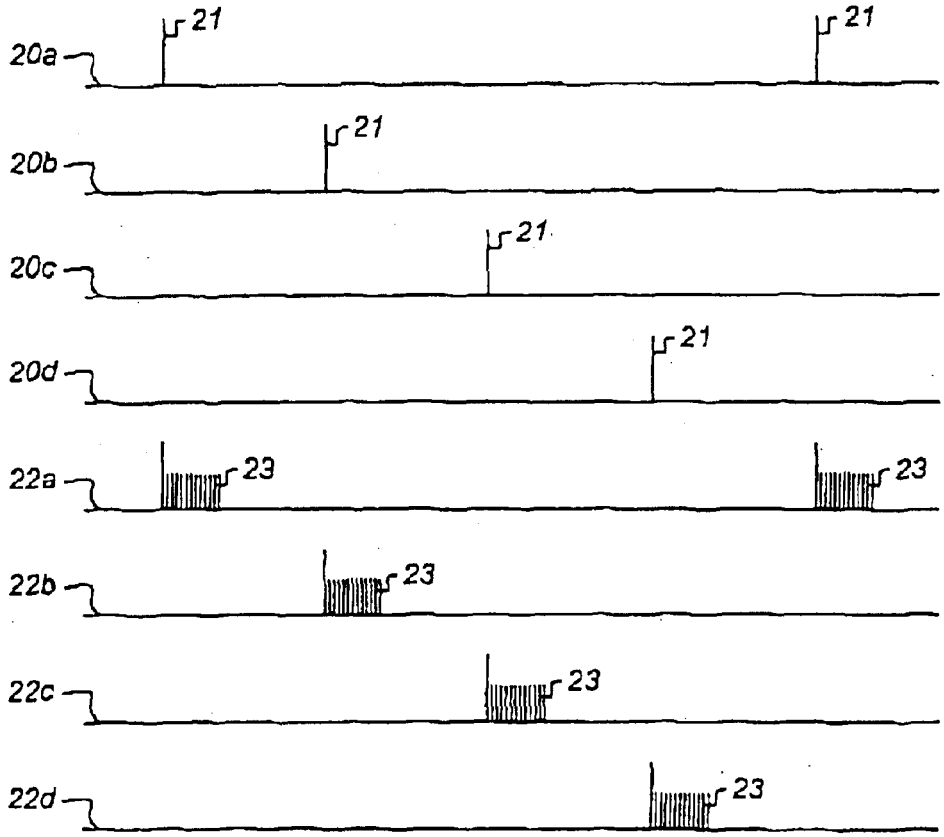
FIG. 3 shows a switching pattern.

FIG. 3 shows a switching pattern of the ignition of FIG. 1. A first number of signals 20*a–d* show control pulses 21 of the engine management system 10 for respective high-frequency generators 14*a–d* in different signals. The engine management system 10 sends a pulse 21 each time when a gas mixture in the cylinder 19 concerned is to be caused to combust. A second number of signals 22*a–d* show pulses 23 each indicating a time interval in which high-frequency generators 14*a–d* connect the primary windings of the different transformers 16*a–d* with the supply 12. For each pulse 21 of the engine management system 10, a high-frequency generator 14*a–d* generates a large number of such pulses 23, i.e. a pulse train. As a result, each time energy from the supply is led into the primary winding of the transformer 16*a–d* and via the secondary winding to the spark plug 18*a–d*. Preferably, the amplitude of the first pulse in the pulse train 23 is higher than the amplitude of subsequent current pulses in the pulse train 23, see FIG. 3. The first pulse may for example result in a pulse in the secondary winding having an amplitude above 2 kV, while the other pulses result in secondary winding pulses with amplitudes as low as 300 V or even lower.

As shown, the circuit does not include a capacitor parallel with the primary winding of the transformers 16*a–d*. This is not necessary because the circuit is not based on oscillating exchange of energy between the primary windings and a capacitor. The current through the primary windings is completely determined by the high-frequency generators 14*a–d*. If there is a resonant circuit at all at the output of the high-frequency generators 14*a–d* of which a primary winding forms a part (for instance as a result of parasitic capacitances), the resonant frequency is far beyond the frequency with which the high-frequency generators 14*a–d* deliver the pulses 23.

As in this way the full energy does not need to be stored at a single time in the primary winding, a relatively small self-induction of, for instance, around 10 milliHenry (or in the range of 3–30 milliHenry) will suffice for these windings. For such relatively small self-inductions, it is easy to make transformers that have few losses up to fairly high frequencies up to above 100 kHz. This permits working with frequencies for the pulses 23 coming from the high-frequency generators 14*a–d* in a range of 10 to at least 100 Kilohertz.

Figure 4:
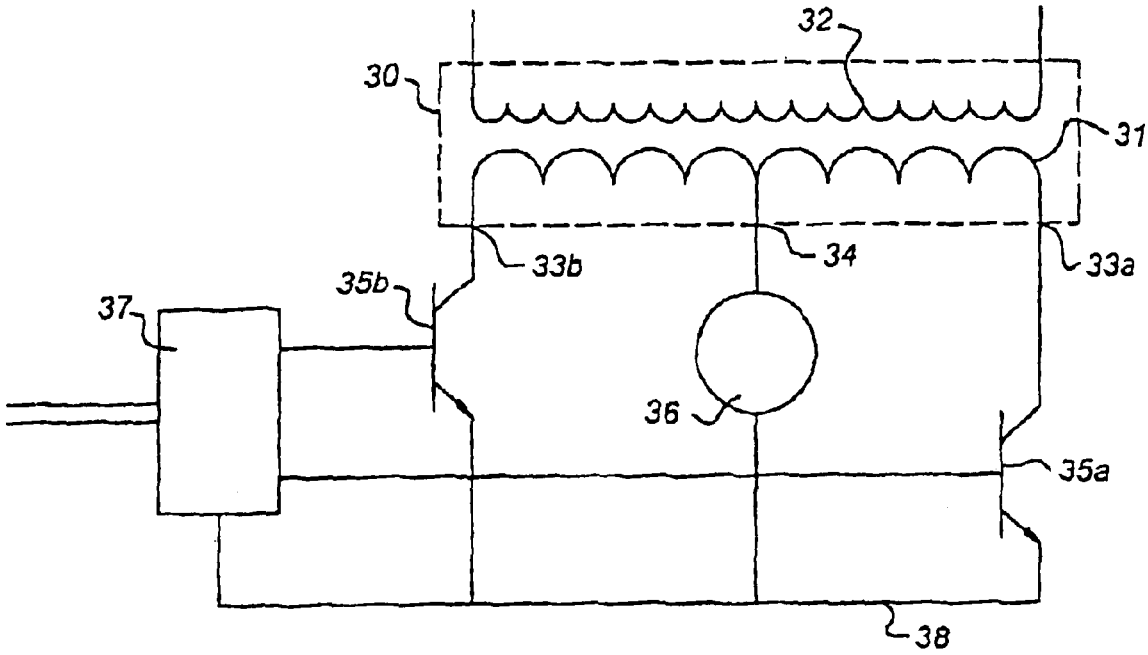
FIG. 4 shows a high-frequency generator.

FIG. 4 shows an example of a high-frequency generator for use in an ignition such as shown in FIG. 1. FIG. 4 shows the transformer 30, with the primary winding 31 and the secondary winding 32. The primary winding 31 has connections 33*a, b* at the terminal ends and a connection 34 in the middle.

The circuit further comprises a voltage source 36, transistors 35*a, b* and a control circuit 37. The voltage source 36, for instance a storage battery, is coupled between the central connection 34 and to a common connection 38. The control circuit 37 has control outputs coupled to the control electrodes of the transistors 35*a, b*. Each transistor 35*a, b* has a main current channel which is coupled between one of the end connections 33*a, b* and the common connection 38.

In operation, the control circuit 37 receives a synchronization signal that indicates when the gas mixture in a cylinder is to be caused to combust. The control circuit 37 thereupon generates a sequence of pulses on the control electrodes of the output transistors 35*a, b,* in each case first a pulse on the control electrode of a first output transistor 35*a,* virtually directly followed by a pulse on the control electrode of a second output transistor 35*b*. The pulses render the main current channel of the output transistors 35*a, b* in question conductive during the pulse. Thus, alternately, pulse-shaped currents flow in mutually opposite directions through a part of the primary winding 31. These currents generate magnetic fields which generate voltage in the secondary winding 32 which is applied across the electrodes of a spark plug (not shown).

By making use of two output transistors 35*a, b* which alternately generate opposite fields, the energy dissipation in the output transistors 35*a, b* is limited. Preferably, the transformer 30 includes a magnetic core, for instance of ferrite, to couple the primary winding 31 and the secondary winding 32. Through the alternate use of the output transistors 35*a, b,* it is moreover ensured that the field in the magnetic core is averagely zero, so that the magnetic core can be optimally driven to full output. Without deviating from the invention, however, it may suffice to use a single output transistor, this output transistor and the voltage source 36 being coupled to opposite terminal ends 31 of the primary winding.

It will be clear that the output transistor or transistors of the high-frequency generator preferably switches between a condition in which this transistor is conductive as much as possible and a condition in which it is conductive as little as possible. Thus, a minimum of energy is dissipated in the high-frequency generator. Without deviating from the invention, however, a more gradual switching is possible, whereby the voltage drop across the output transistor is controlled more gradually by the control signal on the control electrode.

The control circuit 37 controls the amount of power which is supplied to the spark plug by setting of the width of the pulses on the control electrodes of the transistors 35*a, b*. In principle, the control circuit 37 can then keep the repeat frequency with which it delivers the pulses constant, or vary it independently of the pulse width. Also, the distance between the pulses on the control electrodes of different transistors 35*a, b* can be set freely, though preferably with avoidance of overlap between the pulses, since that does not lead to energy transfer.

More generally, the duty cycle, that is, the fraction of the time when the high-frequency generator 14*a–d* connects the primary winding with the supply 12, is modulatable. Thus, the amount of energy which is supplied to the spark plug 18*a–d* can be regulated. Also, the amount of energy can be regulated by regulation of the frequency of the pulses 23 given a fixed pulse width.

Such regulation or regulations are preferably under the control of a signal of the engine management system 10, which controls the duty cycle, for instance depending on the condition of the engine (temperature, speed, etc. ), to provide for an optimum combustion of the gas mixture with a minimal energy consumption from the supply.

What is claimed is:

1. An internal combustion engine, comprising:

a cylinder with a spark plug;

an electric DC voltage supply; and an ignition circuit, wherein the ignition circuit includes a switching device and a transformer having a primary winding coupled to the supply via the switching device, and a secondary winding coupled to the spark plug, the switching device is configured such that after having generated an initial breakdown of a breakdown path through a gas mixture between electrodes of the spark plug, switching occurs repeatedly per combustion to produce pulses at the primary winding, with a repeat frequency which is at least sufficiently high that the breakdown path remains conductive between consecutive switches per combustion, so that the switching on and switching off leads to a heating of the breakdown path in order to ignite said gas mixture, and wherein said transformer comprises an air core around which the primary and secondary windings are arranged concentrically.

2. The internal combustion engine according to claim 1, wherein the switching device is arranged to make the electric connection between the supply and the primary winding conductive and to interrupt it with a frequency of at least 100 kilohertz.

3. The internal combustion engine according to claim 1, wherein said ignition circuit is arranged to produce a pulse train at the secondary winding, wherein a first pulse of said pulse train has an amplitude of at least 2 kilovolt, and wherein subsequent pulses of said pulse train have amplitudes of less than 300 Volt.

4. An ignition circuit comprises:

a switching device and a transformer having a primary winding coupled to the supply via the switching device, and a secondary winding coupled to the spark plug, the switching device is configured such that after having generated an initial breakdown of a breakdown path through a gas mixture between electrodes of the spark plug, switching occurs repeatedly per combustion to produce pulses at the primary winding, with a repeat frequency which is at least sufficiently high that the breakdown path remains conductive between consecutive switches per combustion, so that the switching on and switching off leads to a heating of the breakdown path in order to ignite said gas mixture, and wherein said transformer comprises an air core around which the primary and secondary windings are arranged concentrically.

* * * * *

UNITED STATES PATENT AND TRADEMARK OFFICE

CERTIFICATE OF CORRECTION

PATENT NO. : 6,953,032 B2
DATED : October 11, 2005
INVENTOR(S) : Goede

It is certified that error appears in the above-identified patent and that said Letters Patent is hereby corrected as shown below:

Column 3,
Line 22, before "Therefore, the invention...", insert -- SUMMARY OF THE INVENTION --.

Signed and Sealed this

Ninth Day of May, 2006

JON W. DUDAS
*Director of the United States Patent and Trademark Office*